United States Patent [19]

Del Vacchio

[11] Patent Number: 5,056,572

[45] Date of Patent: Oct. 15, 1991

[54] CADDY FOR USE WITH A POWER SAW

[76] Inventor: Vincent A. Del Vacchio, 2747 Harmil Rd., Broomall, Pa. 19008

[21] Appl. No.: 623,775

[22] Filed: Dec. 7, 1990

[51] Int. Cl.[5] ..... A47F 5/08; B25H 1/00; B65D 85/28

[52] U.S. Cl. ..... 144/286 A; 108/26; 144/286 R; 206/373; 211/86

[58] Field of Search ..... 206/372, 373; 144/285, 144/286 R, 286 A; 211/86; 108/26, 27, 50

[56] References Cited

U.S. PATENT DOCUMENTS

| | | | |
|---|---|---|---|
| 2,637,358 | 5/1953 | Larson | 144/286 R |
| 3,490,601 | 1/1970 | Hain et al. | 207/372 |
| 3,684,102 | 8/1972 | Colter | 211/88 |
| 4,160,570 | 7/1979 | Bridges | 206/373 |
| 4,239,195 | 12/1980 | Ohman et al. | 144/286 R |
| 4,920,895 | 5/1990 | Burke et al. | 108/26 |
| 4,953,764 | 9/1990 | Kovacs | 206/373 |

*Primary Examiner*—W. Donald Bray
*Attorney, Agent, or Firm*—William Freedman

[57] ABSTRACT

This caddy is for use with a power saw having a generally horizontal working table on which items are supported while being cut by the saw. The caddy serves to hold tools and accessories for use by the saw operator in connection with operating the saw or preparing work for the saw. The caddy comprises a receptacle having compartments for receiving the tools and accessories; a pair of brackets, each having a first portion fixed to the receptacle and extending upwardly and a second portion that is adapted to be attached to the table; and means for attaching the second portion to the table adjacent one edge of the table, thereby positioning the receptacle in a position underneath the table and vertically spaced from the table near said one edge.

8 Claims, 4 Drawing Sheets

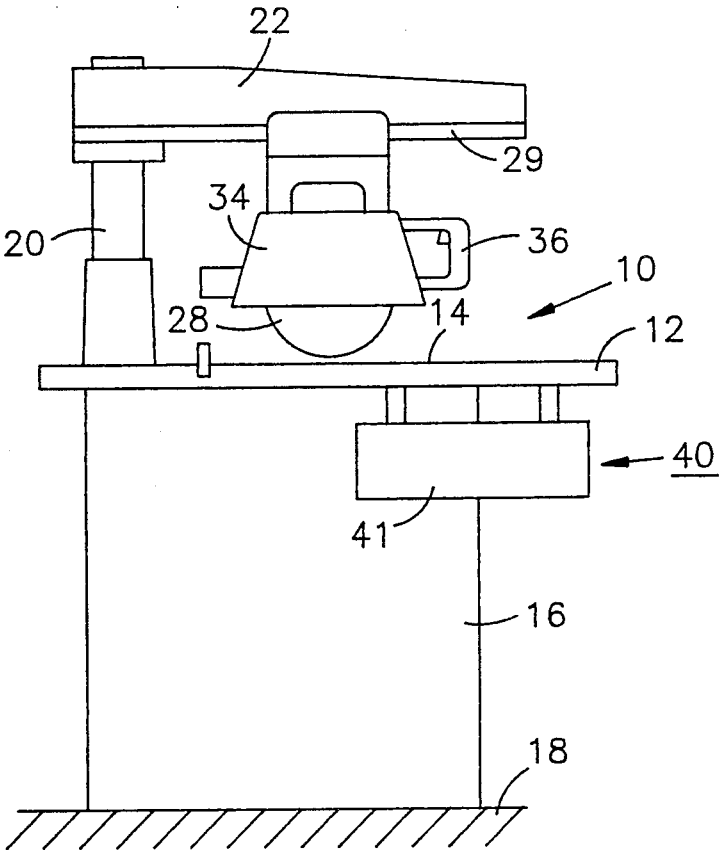
Fig. 1
Fig. 2
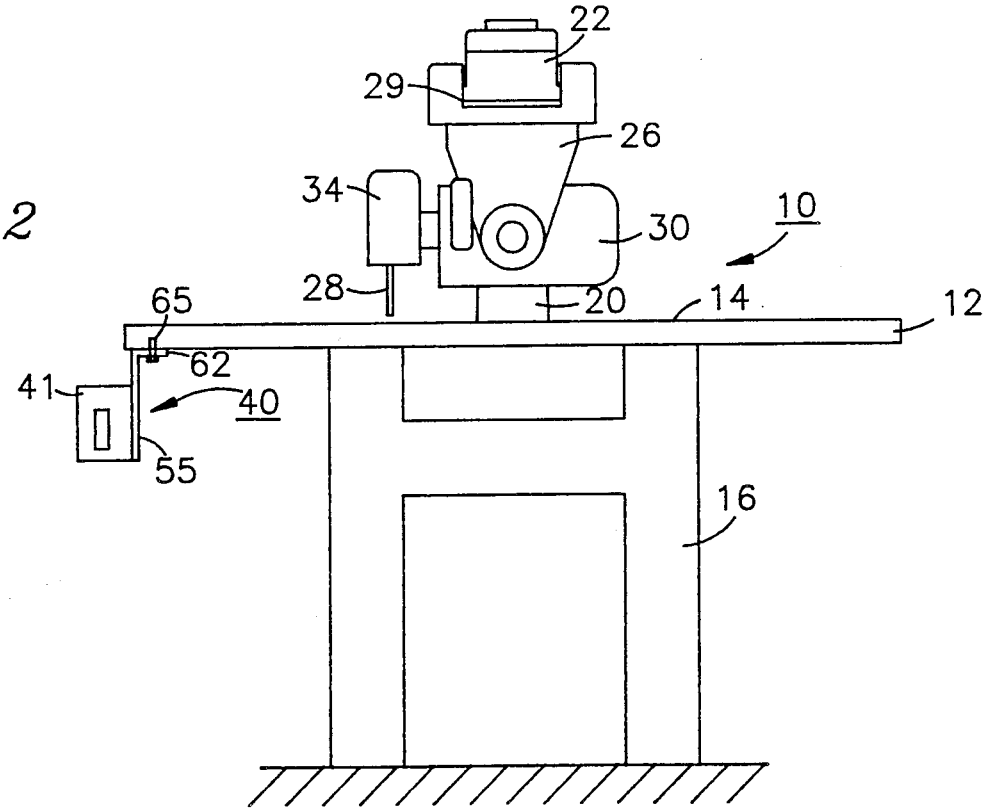

CADDY FOR USE WITH A POWER SAW

FIELD OF THE INVENTION

This invention relates to a caddy for use with a power saw and, more particularly, relates to a caddy for such use that is capable of holding various tools and accessories for the saw in a readily accessible, but non-interfering, position with respect to the saw.

BACKGROUND

The operation of a power saw requires a variety of tools and accessories for efficiently operating the saw and preparing work for the saw. Not infrequently, the operator has laid these tools and accessories down in random locations about his working area, and he must spend many frustrating minutes searching about to locate the needed item.

OBJECTS

An object of my invention is to provide for a power saw a caddy for holding the required tools and accessories in an organized fashion and, more specifically, in a readily accessible location where the caddy and its contents will not interfere with proper operation of the saw.

Another object is to provide a caddy capable of fulfilling the immediately-preceding object and also capable of being readily adjusted in its position with respect to the power saw.

Another object is to provide a caddy of the above type which readily lends itself to use with a variety of different models and types of power saws.

SUMMARY

In carrying out the invention in one form, I provide, for a power saw having a generally horizontal working table, a caddy for holding tools and accessories usable by the saw operator in connection with operating the saw or preparing work for the saw. The caddy comprises a receptacle having compartments therein for receiving said tools and accessories; one or more brackets, each having a first portion that is fixed to the receptacle and extends upwardly therefrom and a second portion that is adapted to be attached to the table; and means for attaching said second portion to the table adjacent one edge of the table, thereby positioning the receptacle in a position underneath the table and vertically spaced from the table near said one edge.

BRIEF DESCRIPTION OF FIGURES

For a better understanding of the invention, reference may be had to the following description taken in conjunction with the accompanying drawings, wherein:

FIG. 1 is a side elevational view of a radial-arm power saw including my tool and accessory caddy and embodying one form of my invention.

FIG. 2 is a front elevational view of the power saw of FIG. 1.

DETAILED DESCRIPTION OF EMBODIMENT

Figure 7:
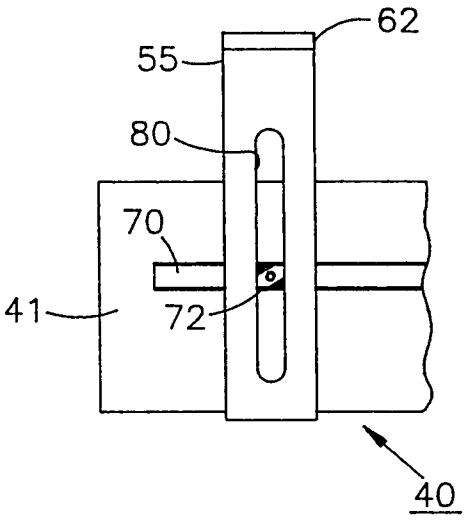
FIG. 7 illustrates another modified form of my invention.

Referring now to FIGS. 1 and 2, there is shown a power saw of the radial-arm type. This power saw comprises a working table 12 that has a top surface 14 extending generally horizontally at about waist height for an operator who would normally stand to the right of the table as viewed in FIG. 1.

The table 12 is fixedly-mounted on a base 16, the lower end of which is supported on a floor 18. Projecting vertically upward from the table 14 is a post 20 on which is suitably adjustably mounted a radially-extending arm 22. Projecting downwardly from the radial arm 22 is a vertically-extending carrier arm 26 on which are suitably mounted a rotary saw blade 28 and an electric motor 30 for driving the rotary saw blade. Between the carrier arm 26 and the radial arm 22, there is conventional slide means 29 (the details of which are now shown) that allows the vertically-extending carrier arm 26 to be horizontally moved along the length of the radial arm 22. Such movement of the carrier arm 26 carries the rotary saw blade 28 in a horizontal direction across any work piece (not shown) which might then be positioned on the saw table, thereby cutting the work piece, as desired.

Covering most of the rotary saw blade 28 is a protective hood 34 that is fixed to the carrier arm 26. The carrier arm 26 has a handle 36 on it that can be grasped by an operator to horizontally move the saw blade, as above described, to effect the desired cutting action. The saw as described up to this point is a conventional radial-arm power saw and, primarily for that reason, is shown in simplified schematic form.

The operator of a power saw requires the use of various tools and accessories for preparing work for the saw and for operating the saw. For example, he might need a tri-square and various rulers and pencils for locating and marking the desired location of the cut on the work piece, and he might need a wood pusher for pushing wood through the blade region when the push zone of the work piece is located near the blade. I have provided the power saw with a tool caddy 40 for storing the needed tools and accessories in an organized fashion until the operator is ready to use them.

Assuming first that there is no such tool caddy present, it often happens that the saw operator will have laid one or more of these tools and/or accessories down in random locations about his working area, and he will be required to spend much time searching about to locate the needed item. But with my tool caddy present, such searching about will usually be unnecessary.

Figure 3:
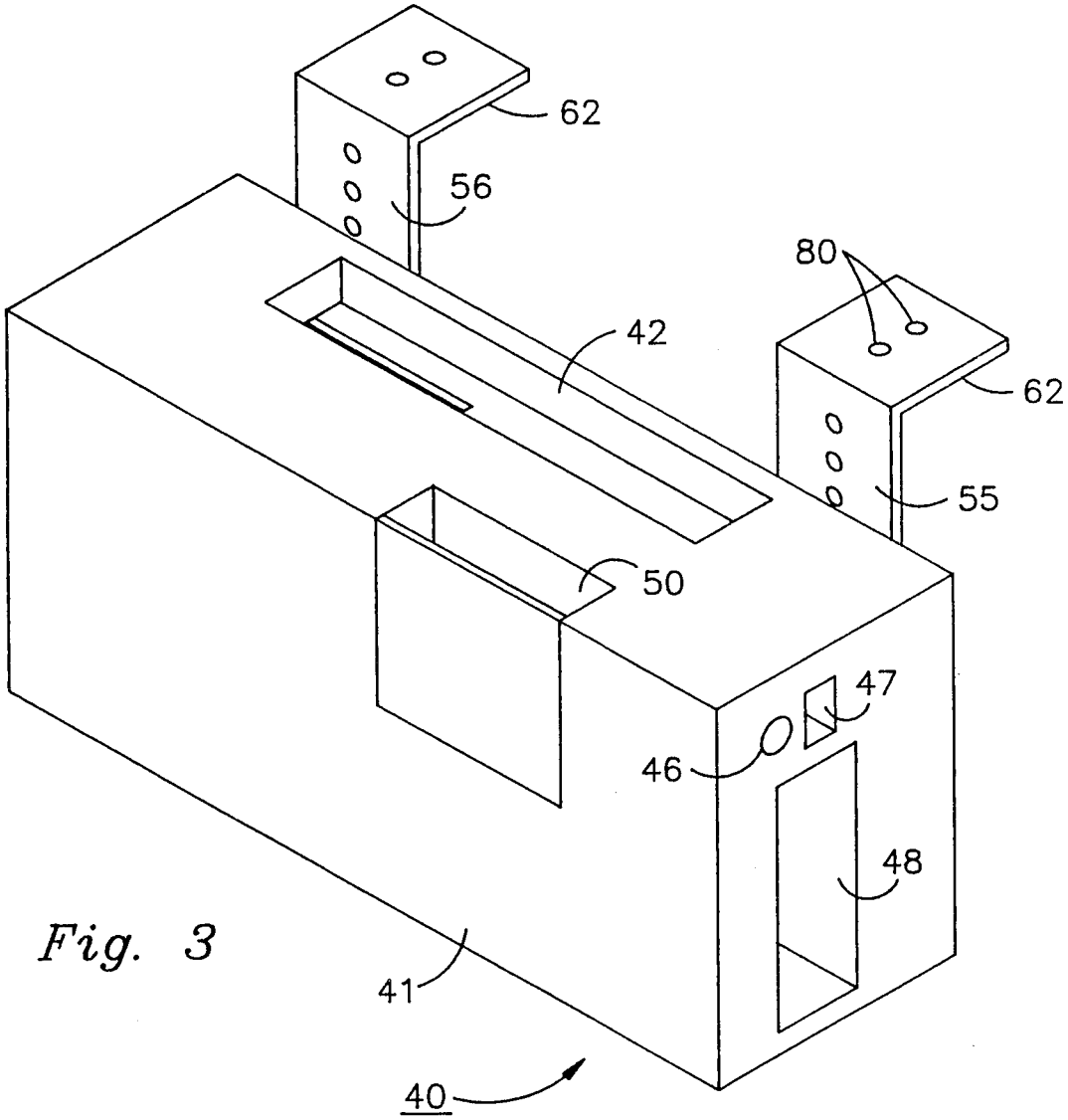
FIG. 3 is an enlarged perspective view of the tool and accessory caddy present in the saw of FIGS. 1 and 2.

The tool caddy comprises a box-like receptacle 41 that contains many compartments in which the tools and/or accessories can be stored in an organized, easily-retrievable fashion. For example, referring to FIGS. 3 and 4, the box-like receptacle has an entryway 42 at its top leading to a compartment 43 in which a tri-square (such as shown at 49) can be stored. At its end facing the operator's location are entryways 46, 47, and 48 leading respectively to compartments for storing a regular pencil, a carpenter's pencil, and a foldable 6-foot wooden ruler. At the left hand side of the receptacle is a compartment 50 for receiving the clip of a tape measure suspended from this side of the receptacle.

At the right hand side of the receptacle 41 there are two brackets 55 and 56, each of inverted L-shape. Each bracket has a vertically-extending portion 60 that is fastened at its lower end to the receptacle 41 and has a horizontally-extending flange portion 62 at its upper end adapted to be fastened to the underside of the table 12 The flange portions 62, in one embodiment, are connected by screws 65 to the underside of the table 12 in a position near the left hand edge of the table, as seen in FIGS. 2 and 4.

Figure 4:
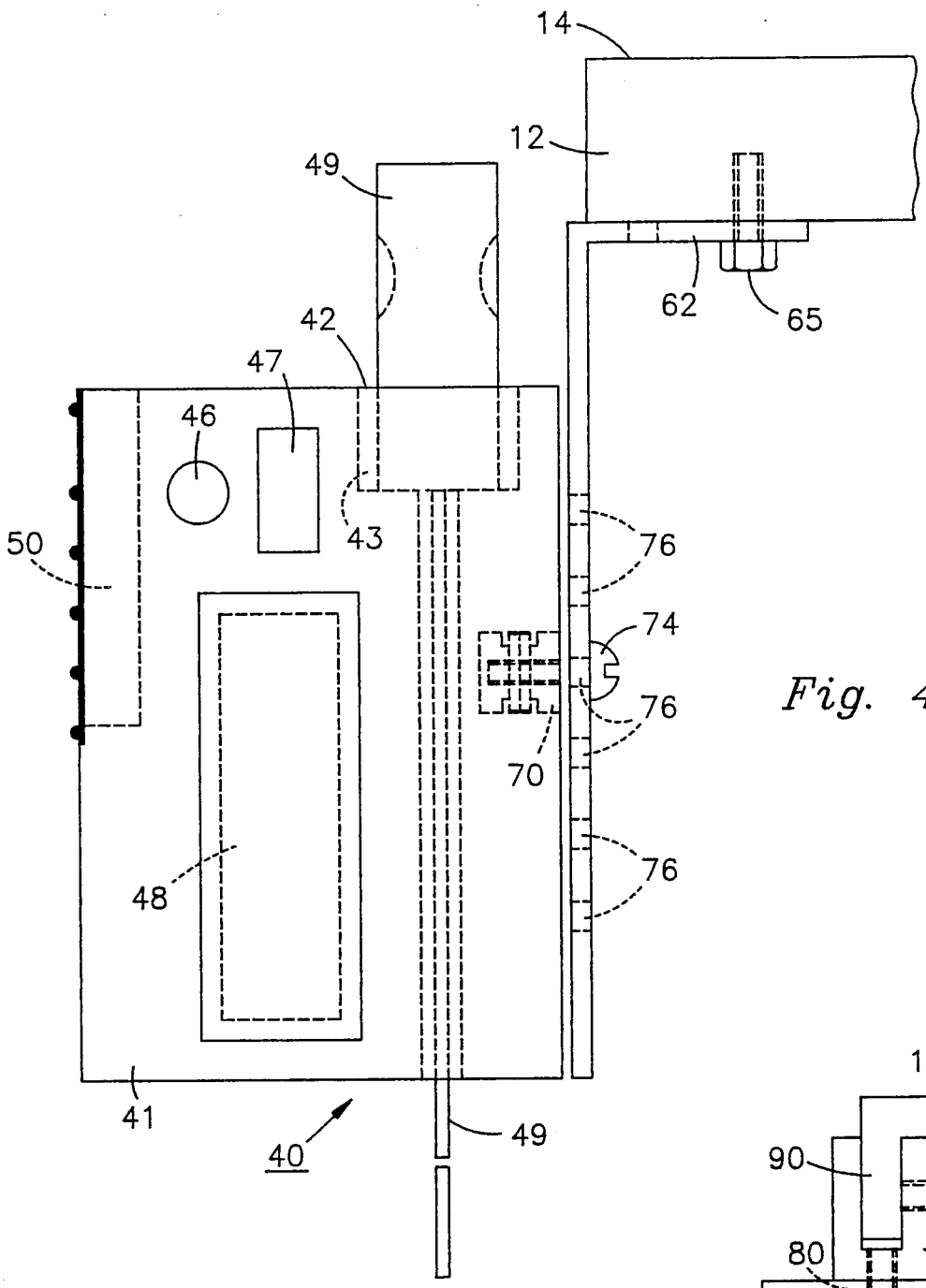
FIG. 4 is an end view of the caddy of FIG. 3.
Figure 5:
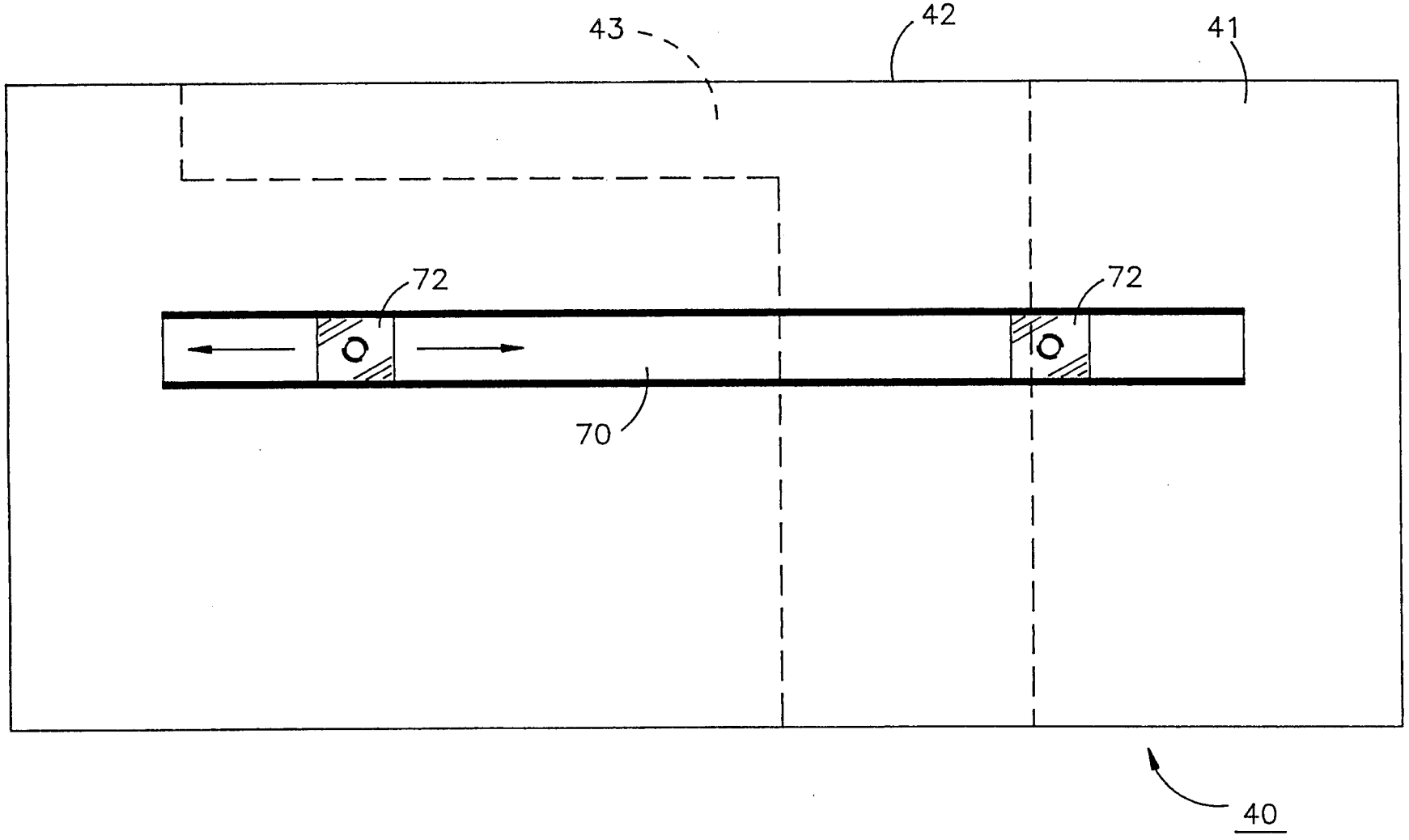
FIG. 5 is a side view of the caddy of FIG. 3, but without its supporting brackets.

Referring to FIGS. 4 and 5, the connection between the brackets 55 and 56 and the receptacle 41 is an adjustable coupling that comprises a horizontally-extending slot 70 in the right-hand side of receptacle and two nuts 72 that are captured within the slot 70. Each nut 72 received a bolt 74 that extends through one of the brackets and has its inner end threaded in the nut. When the bolts 74 are loose in their associated nuts, the receptacle 41 can be moved horizontally with respect to the brackets since the nuts 72 are then freely slidable with respect to the surrounding slot 70. When the receptacle has been moved horizontally to its desired position with respect to the brackets, the bolts 74 are tightened within their associated nuts. This forces the nuts 72 against a horizontally-extending flange 77 within the slot 70, thereby clamping the side of the receptacle against the brackets 55 and 56 in the desired position of adjustment.

Vertical adjustment of the receptacle with respect to the brackets can be effected by removing the bolts 74 from the nuts 72 and then lowering or raising the receptacle 41 to the desired position, where one of the several vertically-spaced holes 76 in each bracket aligns with the associated nut. The bolt 74 is then inserted through this hole and threaded into the nut 72, again clamping the side of the receptacle to the associated bracket when the bolt is fully tightened.

In a modified form of the invention, shown in FIG. 7 each of the brackets is provided with a vertically-extending slot 88 instead of the spaced holes shown therein. The threaded shank of the associated bolt 74 extends through this slot into its nut 72. When the two bolts 74 are loosened, the receptacle 41 together with the bolts may be raised or lowered to a desired vertical position. Then the bolts are tightened within their associated nuts to clamp the receptacle in place at the desired vertical position. This embodiment allows for vertical adjustments of the receptacle without the necessity of removing the bolts.

It is to be noted that my entire caddy 40 is positioned beneath the saw table 12 and does not project above the top surface 14 of the table. As a result, the caddy 40 does not interfere with any work piece which might overhang the edges of the saw table 12. For example, a wide sheet of plywood which projects out beyond the left hand edge of the table as viewed in FIG. 2 can be positioned flush with the top surface 14 of the table with no interference from the caddy.

Moreover, the brackets 55, 56 position the receptacle 41 in an easily accessible position for the operator. He can easily extract tools or accessories from the receptacle without undue bending or searching. He can also easily return these items to their proper places in the receptacle 41 after he is finished with them in view of the open, easily-accessible location of the caddy.

Because the receptacle 41 is located at the edge of the table 12 as seen in FIG. 2, its top surface is completely unobstructed by the table. This is advantageous because it allows long tools or accessories such as the tri-square 49 to be inserted into the receptacle 41 through the top entryway 42 without interference from the table 12. Similarly, the table does not interfere with extraction in an upward direction of such a long tool or accessory from the receptacle 41.

In the embodiment of FIGS. 1 and 2 the table 12 will typically be made of wood and suitable wood screws 65 can therefore be used for attaching the brackets 55 and 56 to the table. Preferably, the attaching flanges 62 have a plurality of holes 80 therein capable of receiving screws 65 and allowing for horizontal adjustment of the flanges depending upon the holes used.

Figure 6:
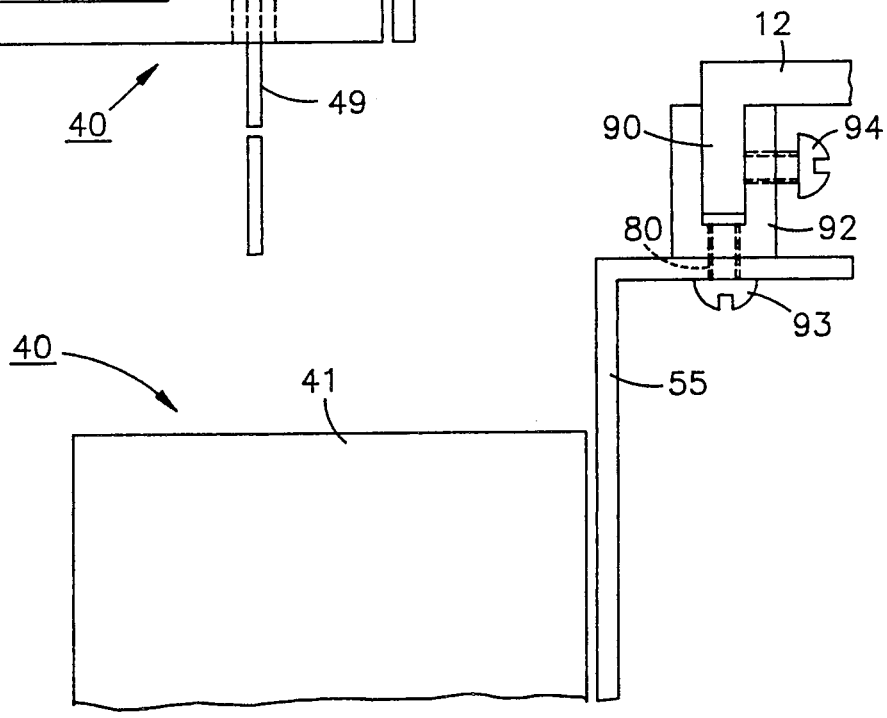
FIG. 6 illustrates a modified form of my invention.

In some types of power saws the working table is of metal rather than wood. Such a saw is depicted in FIG. 6, where the metal table is shown at 12. This table has a downwardly projecting flange 90 at its outer edge. I utilize this flange 90 for supporting the brackets 55 and 56 of the caddy. This is done by providing for each bracket 55 and 56 a U-shaped clamp 92 that is fastened to the upper flange 62 of the bracket by a screw 93 extending through one of the holes 80 therein. One leg of the U-shaped clamp contains a threaded hole, and through this threaded hole a clamping screw 94 extends. When this screw 94 is tightened, the flange 90 is tightly clamped within the clamp, thus securely fixing the associated bracket to the table.

It will be apparent that the caddy of FIG. 6 is the same as that of FIGS. 1–5 except for the U-shaped clamp 92, 94 at its top. Thus, if one purchases the caddy 40 of FIG. 3, he can readily use it as shown in FIGS. 1 and 2 or as shown in FIG. 6. No change need be made in the caddy itself.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. In a power saw having a generally horizontal working table on which items are supported while being cut by the saw, said table having a plurality of edges, a caddy for holding tools and accessories usable by the saw operator in connection with operating the saw or preparing work for the saw, said caddy comprising:

(a) a receptacle having compartments therein for receiving said tools and accessories, (b) one or more brackets, each having a first portion that is fixed to said receptacle and extends upwardly therefrom and a second portion that is adapted to be attached to said table, and (c) means for attaching said second portion to said table adjacent one of said table edges and thereby positioning said receptacle in a position underneath the table and vertically spaced from the table near said one edge, and in which:

(d) said receptacle is a box-like structure, which when mounted underneath the table, has a top surface facing the underside of said table and an end surface facing the normal location of the saw operator, and (e) one of said compartments has an entryway through the top surface of said receptacle through which an elongated tool or accessory can be inserted into said one compartment and another of said compartments has an entryway through said end surface through which another tool or accessory can be inserted into said other compartment.

2. The combination of claim 1 in which said receptacle is of elongated configuration and has a length extending generally horizontally when mounted underneath said table, and means adjustably movable with respect to said receptacle is provided for securing said receptacle to said bracket or brackets and for allowing motion of said receptacle along its length with respect to said bracket or brackets.

3. The combination of claim 1 in which said bracket is joined to said receptacle by adjustable means that allows the receptacle to be moved vertically relative to said bracket.

4. In a power saw having a generally horizontal working table on which items are supported while being cut by the saw, said table having a plurality of edges, a caddy for holding tools and accessories usable by the saw operator in connection with operating the saw or preparing work for the saw, said caddy comprising:

(a) a receptacle having compartments therein for receiving said tools and accessories, (b) one or more brackets, each having a first portion that is fixed to said receptacle and extends upwardly therefrom and a second portion that is adapted to be attached to said table, and (c) means for attaching said second portion to said table adjacent one of said table edges and thereby positioning said receptacle in a position underneath the table and vertically spaced from the table near said one edge, and in which:

(d) said receptacle is a box-like structure of elongated configuration having a length extending generally horizontally and means adjustably movable with respect to said receptacle is provided for securing said receptacle to said bracket or brackets and for allowing motion of said receptacle along its length with respect to said bracket or brackets.

5. The combination of claim 4 in which each said bracket is joined to said receptacle by adjustable means that allows the receptacle to be moved vertically relative to said bracket.

6. The combination of claim 4 in which said means for securing the receptacle to said bracket or brackets comprises a slot in one side of said receptacle, a nut captured within said slot, and a bolt extending through one of said brackets and threaded into said nut, said slot permitting the receptacle to be moved generally horizontally with respect to the nut when the bolt is loose in said nut, and said nut being clamped in a fixed position within said slot when said bolt is tightened.

7. The combination of claim 6 in which each said bracket is joined to said receptacle by adjustable means that allows the receptacle to be moved vertically relative to said bracket, said adjustable means comprising an elongated generally vertically-extending slot in said bracket through which said bolt extends, said bolt being movable in said slot when loose in said nut but being fixed relative to said slot when said bolt is tightened.

8. In a power saw having a generally horizontal working table on which items are supported while being cut by the saw, said table having a plurality of edges, a caddy for holding tools and accessories usable by the saw operator in connection with operating the saw or preparing work for the saw, said caddy comprising:

(a) a receptacle having compartment therein for receiving said tools and accessories, (b) one or more brackets, each having a first portion that is fixed to said receptacle and extends upwardly therefrom and a second portion that is adapted to be attached to said table, and (c) means for attaching said second portion to said table adjacent one of said table edges and thereby positioning said receptacle in a position underneath the table and vertically spaced from the table near said one edge, and in which:

(d) each said bracket is joined to said receptacle by adjustable means that allows the receptacle to be moved vertically relative to said bracket.

* * * * *